United States Patent [19]

Hettinger et al.

[11] 4,149,818

[45] Apr. 17, 1979

[54] SUBMERSIBLE CHAMBER ARRANGEMENT

[75] Inventors: Frederic L. Hettinger; Joel Rizzo, both of Palm Beach Gardens, Fla.

[73] Assignee: Perry Oceanographics, Inc., Riviera Beach, Fla.

[21] Appl. No.: 826,661

[22] Filed: Aug. 22, 1977

[51] Int. Cl.[2] ..... B63G 8/00

[52] U.S. Cl. ..... 405/191; 114/312

[58] Field of Search ..... 114/16 R, 16.4, 16.5, 114/312-315, 322, 336; 61/69 R, 69 A, 68, 81, 82, 83; 166/0.5, 0.6; 175/5, 7, 8, 9, 10; 405/191

[56] References Cited

U.S. PATENT DOCUMENTS

| | | | |
|---|---|---|---|
| 1,469,574 | 10/1923 | Allan | 405/191 |
| 2,190,330 | 2/1940 | Martine | 405/189 |
| 2,320,696 | 6/1943 | Zoll | 405/190 |
| 2,929,610 | 3/1960 | Stratton | 166/0.5 |
| 3,010,214 | 11/1961 | Postlewaite | 61/69 R |
| 3,229,656 | 1/1966 | Bodey | 114/268 |
| 3,299,950 | 1/1967 | Shatto | 166/0.5 |
| 3,302,709 | 2/1967 | Postlewaite | 166/340 |
| 3,307,627 | 3/1967 | Shatto | 166/344 |
| 3,353,364 | 11/1967 | Blanding | 405/189 |
| 3,400,541 | 9/1968 | Lloyd | 405/190 |
| 3,463,226 | 8/1969 | Johnson | 166/351 |
| 3,465,531 | 9/1969 | Burrus | 61/69 R |
| 3,525,388 | 8/1970 | McClintock | 166/356 |
| 3,568,454 | 3/1971 | Itami | 61/69 R |
| 3,587,504 | 6/1971 | Kearney | 114/16 R |
| 3,592,014 | 7/1971 | Brown | 405/169 |
| 3,641,777 | 2/1972 | Banjavich | 405/188 |
| 3,765,607 | 7/1972 | Dorschel | 239/124 |
| 3,851,491 | 12/1974 | Mason | 405/188 |
| 3,855,806 | 12/1974 | Letherisien | 61/69 R |
| 4,030,309 | 6/1977 | Mason | 61/69 R |

*Primary Examiner*—Trygve M. Blix
*Assistant Examiner*—D. W. Keen
*Attorney, Agent, or Firm*—Spencer & Kaye

[57] ABSTRACT

Diving apparatus which includes a bell assembly normally negatively buoyant and including a bell. There is a frame movable vertically beneath the sea surface and having a portion defining a path. Such frame is movable between an upper position and a lower position above the subsea surface at which the frame can be made temporarily stationary. Bell moving apparatus is disposed between the bell assembly and the frame for moving the bell between a lower position adjacent the subsea surface and an upper position adjacent the frame. Apparatus is provided for mounting the bell assembly for movement along such path.

25 Claims, 8 Drawing Figures

SUBMERSIBLE CHAMBER ARRANGEMENT

BACKGROUND OF THE INVENTION

This invention relates to an arrangement for service, maintenance and installation at subsea locations by means of which an operator or diver can be located within a bell and from the interior of the bell operate devices for working at depths within the sea, for example, on wells in offshore petroleum recovery arrangements.

More and more in recent years there has been an increase in offshore gas and petroleum well drilling and recovery and interest increases more and more both in terms of the area where such drilling can occur and the water depths at which these can occur.

Methods had originally been used at shallower depths where divers of various types within the water could provide the maintenance and manipulation and connecting steps necessary during preparation of a well. However, this provides severe limits on the time within which a diver may operate and causes considerable mental and physiological strain on the diver.

Therefore, automatic or remote or robot devices have been used in order to avoid the need for divers, they being controlled from the surface. However, it is important that man be located at the place where maintenance and construction or fabrication is being performed so as to deal with any trouble areas that occur and also to better analyze the situation.

This has led in most recent years to the use of manned bells, preferably atmospheric type, so that decompression is not a problem that needs to be contended with, since it creates problems even when saturation diving is used and also creates enormous expenses.

Apparatus is disclosed in U.S. Pat. No. 3,302,709 for working at an underwater well base. This arrangement provides for automatic devices which use guide lines from a surface location to the subsea well for directing the devices.

A salvaging method is disclosed in U.S. Pat. No. 1,469,574 which includes the use of parallel spaced apart guide rods extending from a salvaging ship to a sunken vessel and along which a frame is guided from the surface to the sunken vessel. The frame has the salvaging mechanism such as locating, cutting, and grappling mechanisms mounted thereon.

A diver controlled salvage bell is disclosed in U.S. Pat. No. 2,320,696, from which the operator within the bell may control movement of the bell with respect to a sunken ship and the diver may, for example, move the device laterally or vertically to position it while it is under water.

U.S. Pat. No. 3,851,491 discloses an underwater bell chamber provided with arms and grippers. The bell is guided along the guide wires from the surface to the subsea well by moving along the guide wires. The grippers are controlled by an operator within the chamber in order to stop and lock movement of the chamber by gripping the guide wires.

SUMMARY OF THE INVENTION

It is an object of the present invention to provide an improved manned submersible bell arrangement from which operators within the bell can view and operate upon devices located at the subsea surface. It is another object to provide such apparatus wherein access is provided to all sides to be worked upon during a single dive.

The present invention provides a bell assembly which is normally negatively buoyant and which includes a bell. Frame means are provided which are movable vertically beneath the sea surface between an upward position and a lower position, the latter being above the subsea surface and at which the frame can be temporarily made stationary. The frame has a path defining portion. Bell moving means are further provided and connected between the bell assembly and the frame means. The bell moving means is used to move the bell between a lower position adjacent the subsea surface and an upper position adjacent the frame means. Mounting means are provided for mounting the bell assembly for movement along such path.

In the more detailed aspects of the present invention a blowout preventer is arranged at the subsea bed or surface and is surrounded by a frame constructed of four vertical members which may be one-piece members or may be a number of members coupled together by flanges at the ends thereof. Guide wires project from each of the vertical members to the surface. A sliding framework is provided and winched from the surface to the guide frame and back up again. The bell assembly is connected to the sliding framework. The sliding framework is slidably connected to all four guide wires which it surrounds and has an offset portion from which the bell depends so as to provide that the bell can be lowered to a vertical position below the top of the guide frame.

Initially, the bell which is normally buoyant and the ballast weight connected to the bottom of it in a movable manner are winched securely and compactly against one another adjacent the sliding framework. This assembly is then lowered down the existing guide wires and is landed on the guide frame. The surface operator then slacks off on the lift line assembly. The entire assembly is designed to be near neutral buoyancy.

Upon landing on the guide frame the operator inside of the bell actuates the ballast weight winch which lowers the negatively buoyant bell/ballast weight combination to the subsea surface or sea bed. When the bottom is reached the bell operator actuates the bell winch permitting the buoyant bell to be adjusted to any desired vertical position between the bottom at which the bell ballast is located and the upper position at which is located the winch mounted on the lower end of the sliding framework.

The manipulative movement and the slide wire framework geometry are such that it is possible for the bell operator to reach any point on the blowout preventer face for servicing. If another surface of the blowout preventer requires servicing, the carriage is moved about the annular framework to provide access to the particular surface of the blowout preventer to be operated on.

DESCRIPTION OF THE PREFERRED EMBODIMENTS

Figure 1:
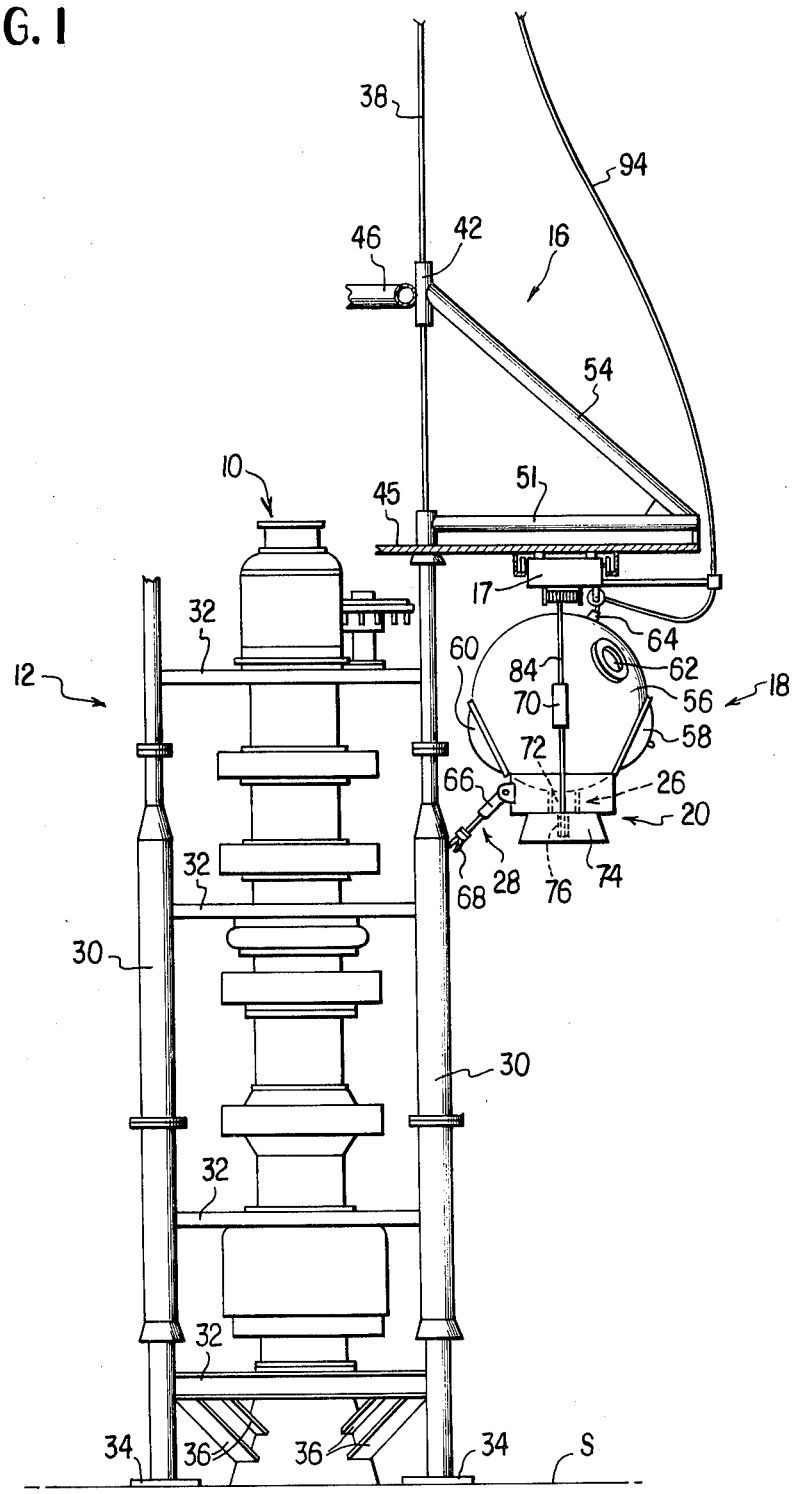
FIG. 1 is a side elevational and a partial sectional view illustrating the bell assembly in a first position with respect to a BOP near the subsea surface.

In FIG. 1, there is generally indicated a blowout preventer (BOP) 10, which is used during drilling to control pressures and it is seated at the subsea surface S in an arrangement which is known in the art. Blowout preventers are standard in this art and generally include elements for closing around the operating tools to seal against high pressure and have a series of valves to allow for control. BOP 10 is surrounded by a guide generally indicated at 12 which includes four vertical rigid guide members 30 arranged at the corners of a square to surround BOP 10. The frame includes cross members 32 and, at least at the lower end, is attached to the BOP at 36 for stability.

A system of guide wires 14 is provided from the sea surface down to the BOP guide 12, one guide wire for each vertical element of the guide, so as to provide guiding means for the transportation from the sea surface to the BOP 10 and back up again for the installation and maintenance of equipment which are needed during drilling.

A sliding annular framework generally indicated at 16 is provided on the four guide wires 38 of system 14. The bell 18 is connected to the sliding framework 16 in a manner which will be described in more detail below.

The sliding framework 16 is lowered down the guide wires and is provided with a horizontally extending annular portion from which the bell 18 depends so that bell 18 is located outside of the area defined by connecting the imaginary lines between adjacent guide wires. The bell 18 is normally buoyant, that is, has positive buoyance, and is provided with a ballast weight 20 which, together with bell 18, comprises the bell assembly. The bell assembly 18, 20 is winched securely and compactly together and adjacent sliding framework 16 at the sea surface. This assembly is then lowered down the existing guide wires and landed on top of the guide 12. The surface operator at this time slacks off on lift lines 88 and 89. The entire bell assembly is designed to be near neutral but negatively buoyant.

Figure 2:
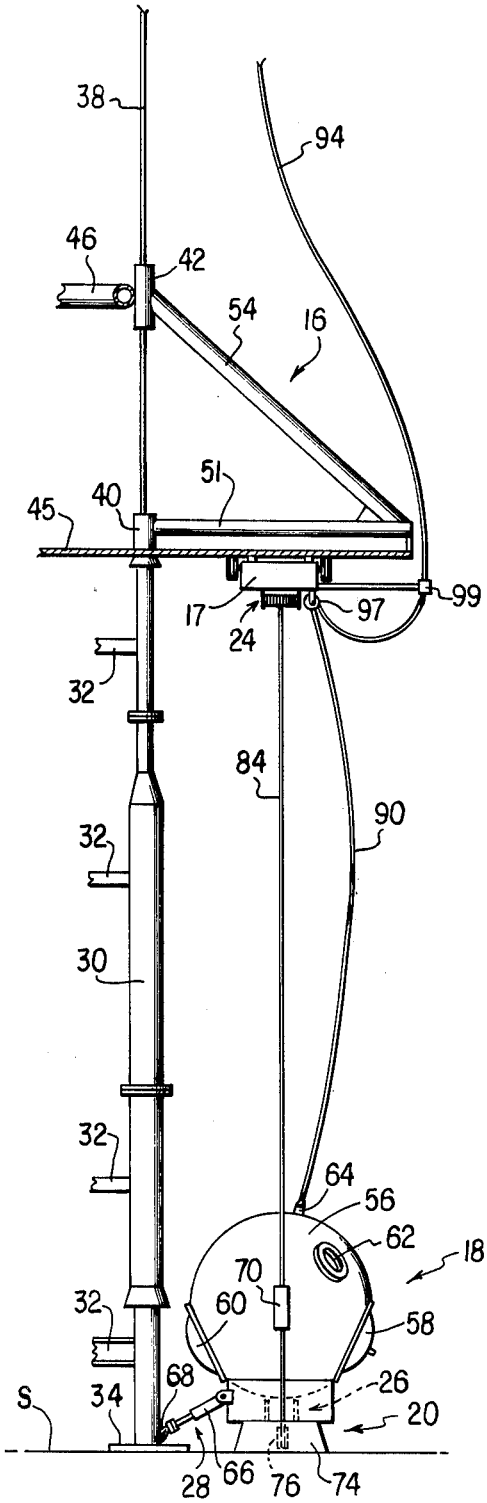
FIG. 2 is a side elevational view similar to FIG. 1 illustrating the bell as the subsea surface.
Figure 3:
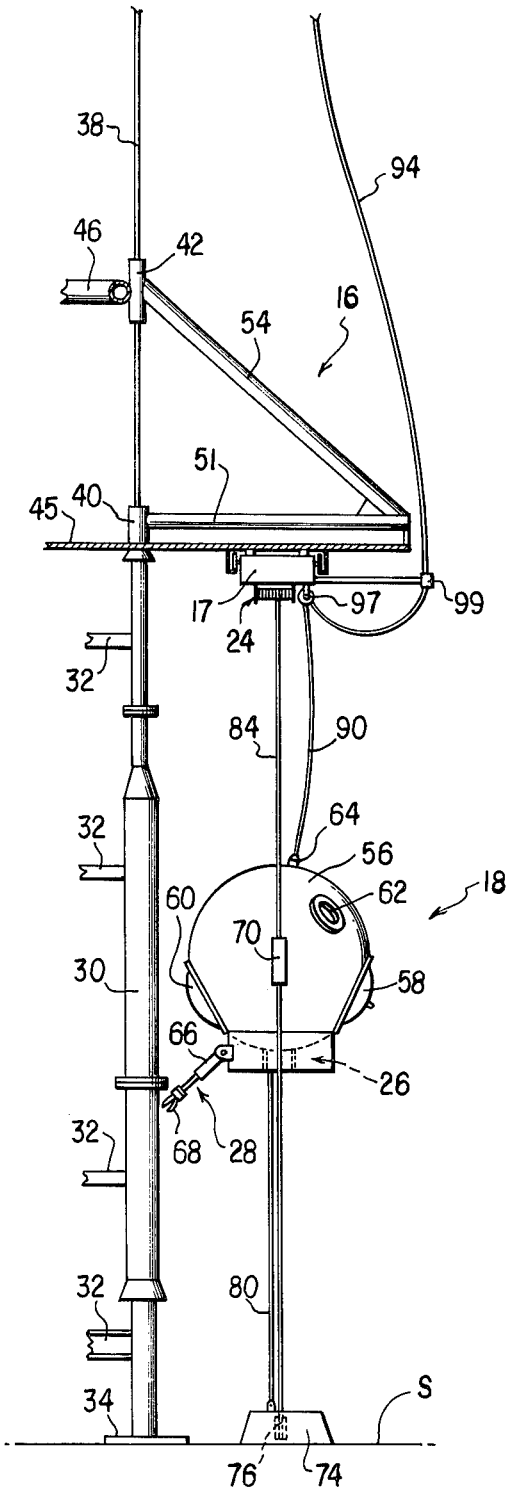
FIG. 3 is a side elevational view similar to the previous figures illustrating the bell in a position between the subsea surface and the sliding framework.
Figure 4:
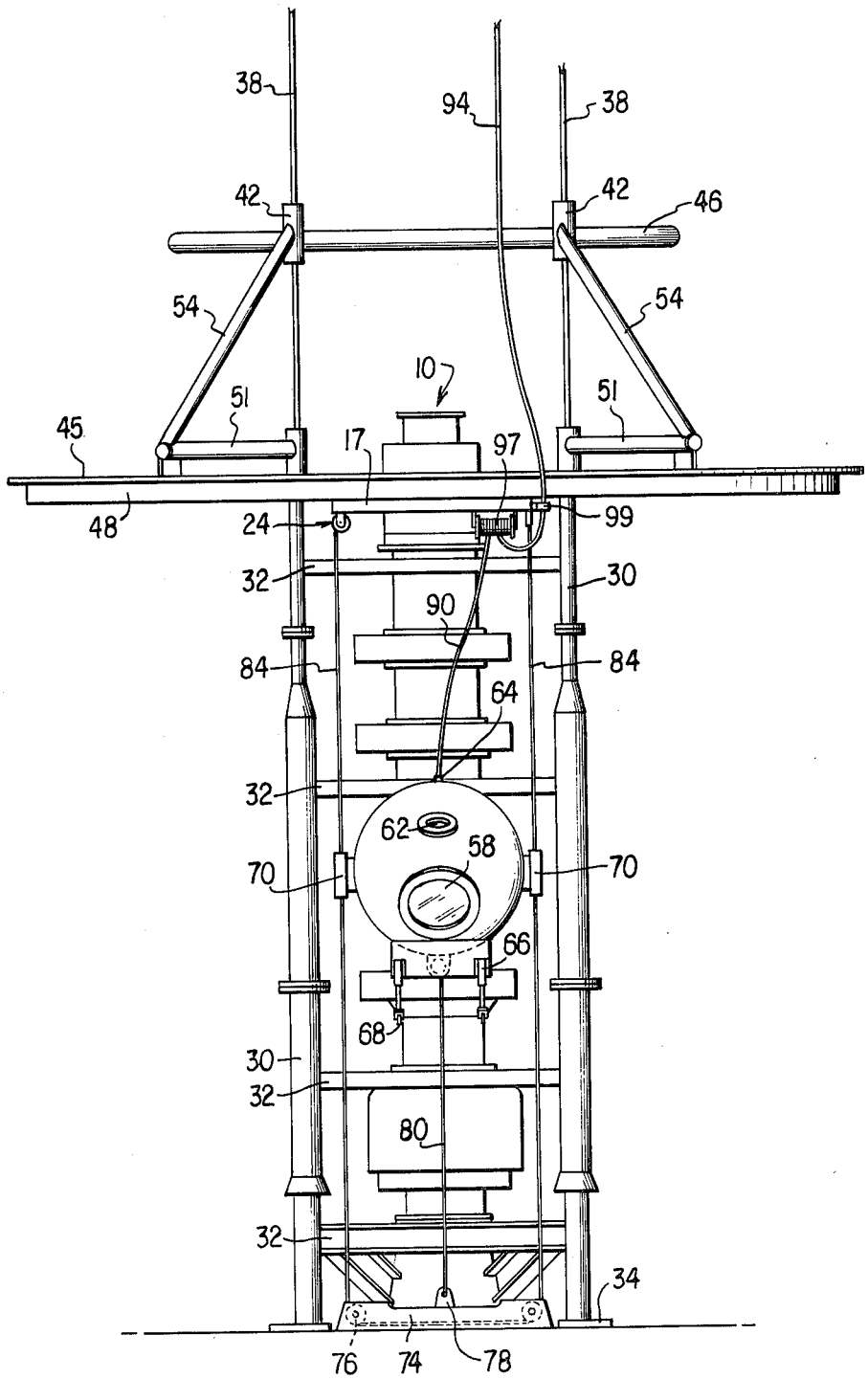
FIG. 4 is a front elevational view with the bell shown in the same position as in FIG. 3.

Upon landing on the guide 12, the bell operator actuates the ballast weight winch 24 to lower the negatively buoyant bell 18/ballast weight 20 assembly to the subsea surface as shown in FIG. 2. Once attaining the bottom, the bell operator actuates the bell winch 26 to permit the buoyant bell 18 to be adjusted to any desired vertical location between the subsea surface and the bottom end of the sliding framework as shown in FIGS. 3 and 4. A manipulator device 28 is provided on the side of the bell 18 facing the BOP 10 in order to permit the operator to operate and make adjustments and the like to the equipment.

The frame 16 is annular in form so that it surrounds the guide wire system 14 and the guide structure 12 completely and is provided with a track. Annular frame 16 has a carriage 17 mounted therewith for movement along an annular track so that by movement of the carriage along the track the bell can be moved in a manner which provides 360° coverage of the BOP 10 by an operator within the bell during a single dive without the need for resurfacing. The carriage itself is provided with equipment, gears, motors, winches, and the like to provide for operational movement of the bell. The carriage can be driven hydraulically or electrically and controlled from within the bell.

Now that the device in general has been described, a more detailed description of the construction and operation of the various elements thereof will be provided.

A guide system is provided containing a guide structure or frame 12 at the bottom and which surrounds the BOP 10, as well as the guide wire system 14 attached to the top of the guide 12 which sits on the bottom and surrounds the BOP. This guide system includes vertical guide members 30 which can be of one piece but, for convenience, might also be constructed in sections as shown so that they can be constructed of any length desired depending upon the structure which they are to surround. Between adjacent vertical guide supports 30 are a plurality of horizontal guide struts 32 to provide rigidity to the structure which is basically a framework. Pads 34 are provided at the lower end of the vertical supports 30 to provide for a distribution of the downward pressure on the sea bed and prevent the guides 30 from sinking into the sea bed. Support struts 36 are connected between the lower end of the BOP and the guide 12 in order to provide further support to both structures which are thereby connected together.

The guide wire system 14 includes four guide wires 38, each of which is connected to a respective vertical support 30 of the guide structure and which extends to the surface in a manner which is known in the art. These four guide wires 38 are connected to the frame structure 12 in a suitable manner and provide a guide system for allowing various devices, machinery and equipment to be raised and lowered in connection with the well drilling operation.

A sliding framework 16 is provided for movement on the guide wires 38 and the sliding framework 16 is constructed in the following manner. It includes four lower sliding guides 40 and four upper sliding guides 42 which can move over the guide wires 38. The guide wires 38 slip through the guides 40, 42 upon movement of the sliding framework 16.

The lower sliding guides 40 are connected together by the inner portion 41 of lower annular member 44 and the upper sliding guides 42 are connected together by an upper annular beam 46.

The lower annular member 44 includes an annular plate 45 disposed in a substantially horizontal plane and which has suspended therefrom annular tracks or rails 47 and 48 which are in spaced relationship with respect to one another for guiding and carrying the carriage 17 in a closed loop or circle around the four guide wires 38. Inner rail 47 and outer rail 48 each have a vertical member 47′ and 48′, respectively, each having one end connected to and suspended from element 45. The other end of each member 47′ and 48′ has horizontal members 47″ and 48″, respectively, connected thereto to form rails 47 and 48 in radially spaced relationship with respect to each other and having the free ends of members 47″ and 48″, respectively, in facing arrangement with respect to each other. The free edges of members 47″ and 48″ may have vertical lips (not shown) to aid in the formation of annular grooved tracks for guiding carriage 17. The carriage rides on tracks 47 and 48 on portions 47" and 48" and will be described below.

The lower sliding guides 40 are connected to the inner surface of annular horizontal plate 45. The outer surface of horizontal annular plate 45 is connected to vertical plates 49 which extend upwardly therefrom to a point disposed above the upper surface of the horizontal annular plate 45. Radial beams 51 are connected between the tops of upwardly extending plates 49 and sliding guides 40 so that a rigid structure is formed by sliding guides 40, radial beams 51, upstanding plates 49, and horizontal annular plate 45. Gusset plates 53 are also provided to add rigidity to the structure. In addition there are inclined supports 54 which are connected from the outer end of radial beams 51 to the upper sliding guides 42.

Thus, a unitary frame is formed including the upper annular beam 46 to which the upper sliding guides 42 are connected, the inclined beams 54, the radial beams 51, the lower sliding guides 40, and the horizontal annular plate 45.

The bell 18 itself is actually a manned atmospheric chamber which is lowered from a surface vessel. It is intended to be operated at atmospheric pressure although other uses may be made of the device. The bell is provided with a life support system which is self-contained for emergencies. The life support is provided from the surface by means of the umbilical 94 connected to umbilical winch 97 and, in turn, to umbilical 90. The bell chamber, its construction, operation, life support systems and the like, as well as the assemblies related thereto, can be the type of structures disclosed in U.S. Pat. No. 3,851,491.

The bell is constructed so that it is buoyant, that is, has a positive buoyancy, so that if unconnected to other equipment it moves upwardly toward the sea surface. The bell itself includes an outer shell 56 having a hatch 56 for ingress and egress to the life support and working chamber. This hatch 58 can be provided with a window for observation if desired. An actual observation window 60 is provided on the side of the bell which faces the BOP and other such windows can be provided at multiple locations such as at port 62. A penetrator 64 is provided to which the umbilical 90 is connected in order to provide air, electrical connections and communication means as well as other types of information and signals which are needed from the bell to the surface during operation, ascent and descent.

In addition to providing for voice communication, the umbilical provides for television communication and for the sensors and gauges in the bell to transmit indications to the surface so that some of the controls can be operated and maintained and continuous surveillance performed from the surface. The side of the bell facing the BOP is provided with manipulators 28 including extendible manipulating arms 66 pivotally connected to the bell and extensible and rotatable and may have, for example, claw-like grippers 68 at the ends thereof which can grip tools, valves and the like and which can be rotated longitudinally of the arms 66. They can be moved up and down and from side to side. Thus, a complete range of movement is provided for the manipulators 28 so that an operator within the bell chamber can provide maintenance and operation of various devices outside of the bell and located within the guide frame 12 and on the BOP.

The outside of the bell 56 is provided with sliding bell guides 70 for a purpose which will be explained in more detail later. The bell itself is provided at the lower end thereof with a chamber in which is located a winch 72 for a purpose which will also be described below.

There is a ballast weight arrangement 20 which includes a ballast weight 74 which is at least sufficiently heavy to overcome the positive buoyancy of the bell and render it negatively buoyant when the bell and the ballast weight are considered together. The exact amount of this weight needs to be determined for the particular application but should be sufficient so that when the ballast is lowered it will be maintained steady on the subsea surface and will maintain bell guide wires 84 connected with it taut as required and as described further below.

The ballast 74 itself is constructed in such a manner as to include idler rollers or sheaves 76 over which a bell guide wire 84 operates and therefore the idler rollers 76 are easily rotatable. A lifting flange 78 is connected to the ballast 74 by which the ballast is connected to a bell ascent/descent cable 80 which is connected from flange 78 to bell winch 72. The bell winch itself includes a motor and a drum onto which the bell ascent/descent cable 80 is wound or unwound depending upon the direction and rotation of the motor. It should be clear that as the winding process takes place the ballast weight and the bell are moved closer together until they are in the position shown in FIG. 1, at which time the ballast weight is immediately adjacent the bottom of the bell and contacting it. When winch 72 is unwound, the bell and the ballast weight are separated as shown, for example, in FIGS. 3 and 4 in which the ballast weight is located on the subsea surface S and the bell itself has ascended halfway to the sliding framework 16.

The ballast weight winch 24 is connected to the carriage 17 movable along the sliding framework 16 and includes a motor driven drum 82 onto which the bell guide cable 84 is wound. One end of the bell guide cable is connected at 86 to one end of the carriage 17 and the other end to the winch 24 at the opposite end of the carriage 17. The bell guide cable 84 is anchored at one end at 86, passes downwardly through a first sliding guide 70 on the bell down to the ballast and around first one idler roller or sheave 76 across the ballast and then around the second idler roller or sheave 76 upwardly through the other sliding guide 70 on the bell and then to drum 82. Thus, as the drum 82 is wound or unwound the ballast will ascend or descend accordingly.

The lift system 22 includes lift lines 88 and 89 connected at diametrically opposite points on annular beam 46 by flanges 91 and 93. The umbilical 90 is provided with all of the fluid carrying means required for providing air from the surface to the ball and with communication means for providing voice communication, possibly television communication, and for transporting the various gauge and sensing indications as well as controls between the bell and the surface. The lift system 22 at the surface is connected to a suitable raising and lowering device such as two topside winches and is connected to the sliding framework 16.

Figure 5:
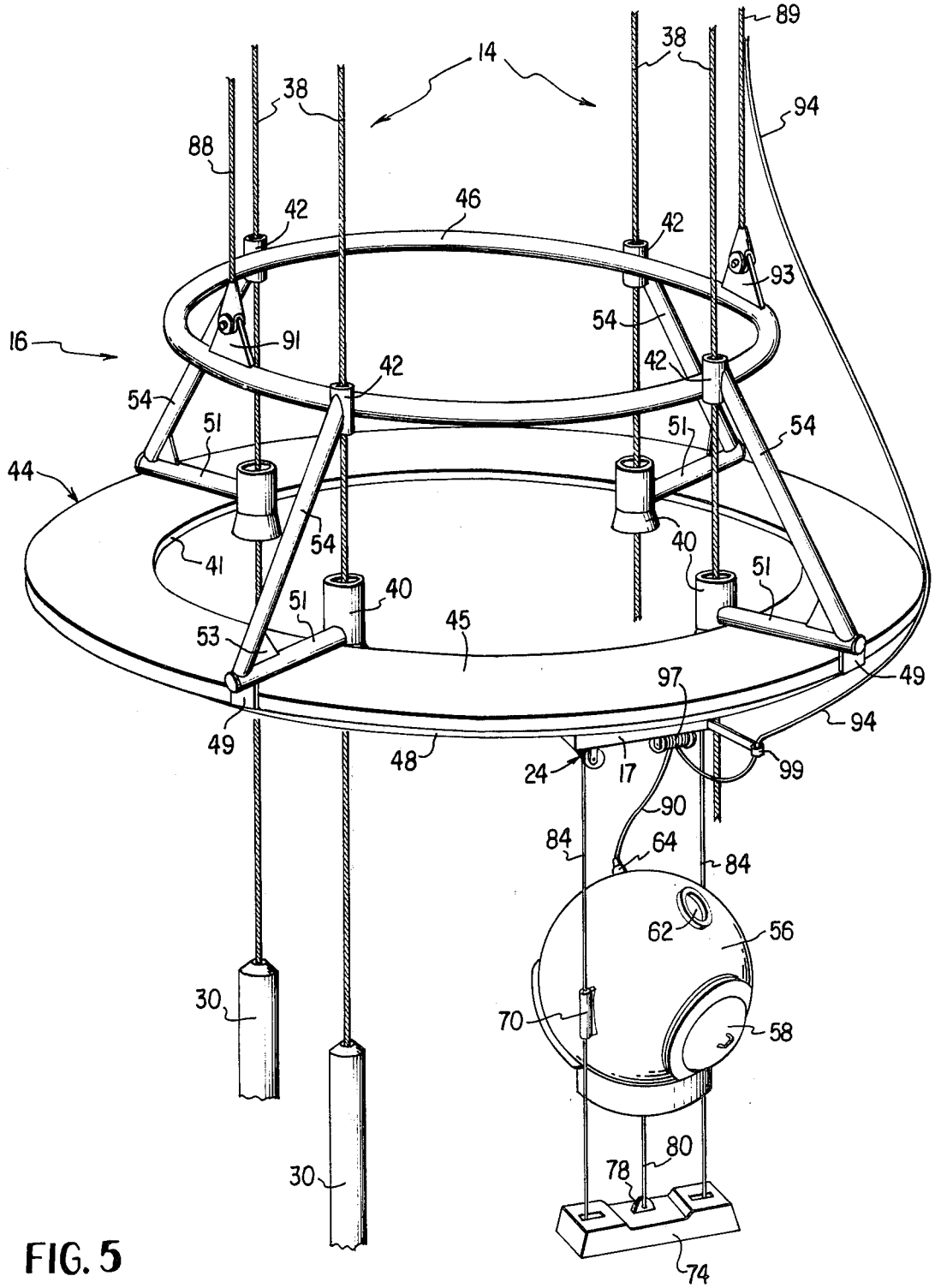
FIG. 5 is a perspective view of the annular framework, carriage, and bell assembly.
Figure 6:
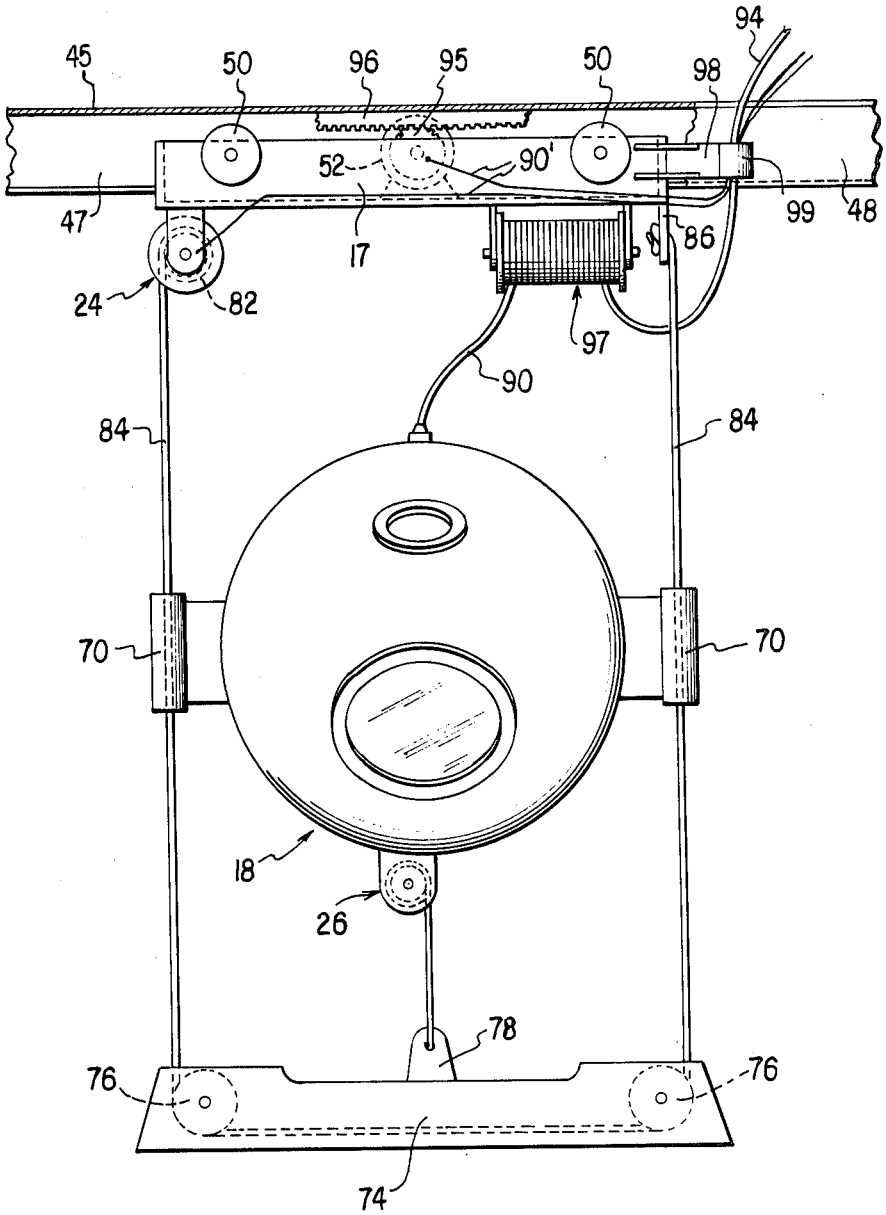
FIG. 6 is an enlarged partial sectional view of the carriage and the bell assembly.
Figure 7:
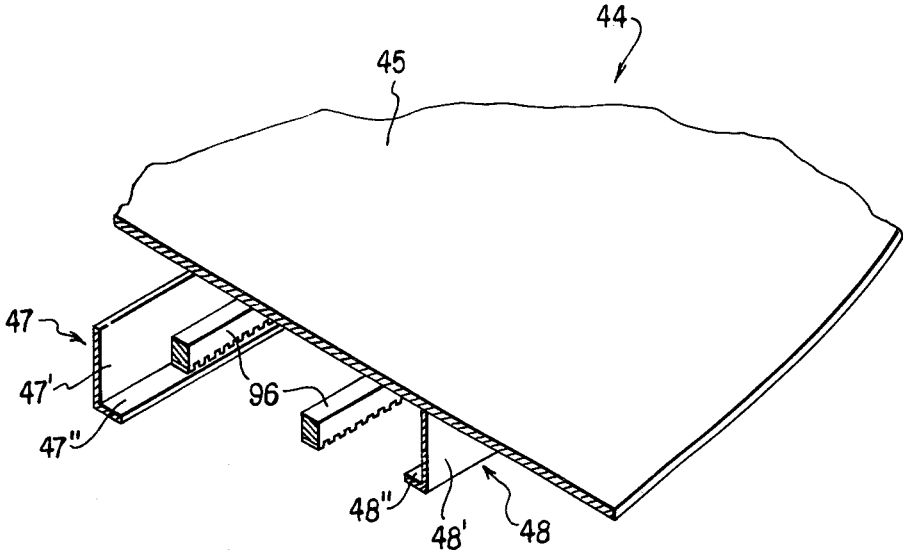
FIG. 7 is an enlarged broken away perspective view of the track assembly.
Figure 8:
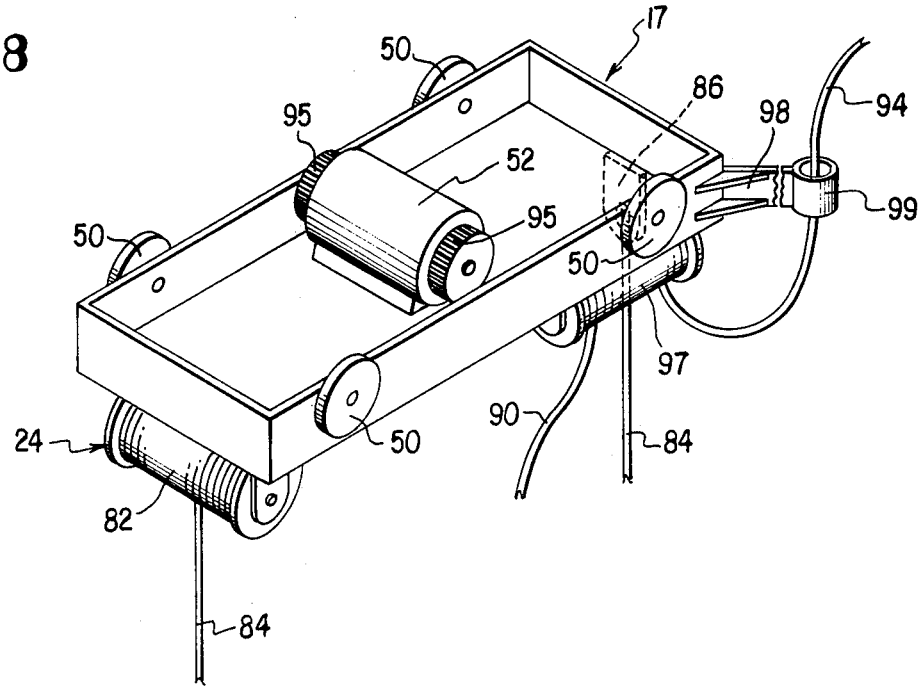
FIG. 8 is an enlarged perspective view of the carriage.

With particular reference now to FIGS. 5 and 6, the carriage 17 itself comprises a frame 43 on which are mounted four wheels 50 which ride on tracks 47 and 48 which maintain the wheels in position along the intended path 44 for the carriage 17. Additional wheels may be mounted on frame 43 to aid in carrying carriage 17 along the intended path 44. A motor 52 is provided which may be hydraulically or electrically operated and by means of which are driven rollers 95 which coact with facing surfaces of drive tracks 96 located on the underside of plate 45. The drive rollers 95 and drive tracks 96 can be in the form of a traveling gear mechanism wherein the gears of the drive rollers 96 intermesh with the teeth of tracks 96 so as to readily provide means for driving the carriage to any intended location.

Bell umbilical line 90 is connected between the bell on one hand, and a bell umbilical winch 97 located on the carriage 17, on the other hand. The umbilical winch, which may be driven by an electric or hydraulic motor, operates to maintain proper length in the umbilical cable 90 when the bell is raised or lowered between the frame 16 and the subsea surface S in order that the cable does not get caught or hung up upon movement of the bell. Further, a guide element 98 is connected to the lower portion of carriage 17 which extends below rails 47 and 48 and extends outwardly beyond the outer edge of horizontal member 44 and having a guide eye 99 at its free end for guiding umbilical 90 coming from the support vessel at the sea surface to the umbilical winch 98 located on carriage 17. The guide element 98 guides umbilical 90 so as not to become caught or hung up upon movement of carriage 17 along the circular track during movement on the 360° path. Umbilical 90 further has communication lines 90' which are capable of operating motor 52 and winches 24 and 98 from signals sent from an operator in bell 18 via support vessel or directly from the support vessel.

The operation of the device will now be described.

The sliding framework 16 is lowered down the four guide wires from the topside winches. One manner of constructing and/or using a guide frame and guide wire arrangement somewhat similar to that disclosed herein is disclosed in U.S. Pat. No. 3,302,709, and a similar system is used in the arrangement disclosed in U.S. Pat. No. 3,851,491, while slightly modified arrangements are disclosed in U.S. Pat. Nos. 3,641,777, 3,353,364, and 3,465,531. The bell assembly 18, 20 is winched securely and compactly together adjacent sliding framework 16 topside at the sea surface. This assembly is then lowered down the existing guide wires and landed on top of the guide 12. The surface operator at this time slacks off on the lift line assembly 22.

Upon landing on the guide 12, the bell operator actuates motor 52 to drive carriage 17 along the track until the bell is facing the side of BOP 10 to be serviced. The bell operator then actuates the ballast weight winch 24 to lower the negatively buoyant bell 18/ballast weight 20 assembly to the bottom as shown in FIG. 2. Once attaining the bottom, the bell operator actuates the bell winch 26 to permit the buoyant bell 18 to be adjusted to any desired vertical location between the subsea surface and the lower portion of the sliding framework 16 as shown in FIGS. 3 and 4. A manipulator device 28 of the type known in the prior art, such as device 75 shown in FIGS. 2, 3 and 9–11 in U.S. Pat. No. 3,851,491, or as disclosed in U.S. Pat. Nos. 3,400,541, 3,229,656, and 3,463,226, is provided on the side of the bell 18 facing the BOP 10 in order to permit the operator to operate and make adjustments and the like to the equipment. By appropriate design of the manipulator movement and slide frame geometry, it is possible for the bell operator to reach any point on the BOP face for servicing.

All motors for winches and the like may be hydraulically or electrically driven and each winch may be provided with its own reversible motor.

It will be understood that the above description of the present invention is susceptible to various modifications, changes and adaptations, and the same are intended to be comprehended within the meaning and range of equivalents of the appended claims.

What is claimed is:

1. Diving apparatus comprising:

(a) a bell assembly normally negatively buoyant and including a bell;

(b) frame means movable vertically beneath the sea surface between an upper position and a lower position above the subsea surface and at which said frame means may be temporarily made stationary, said frame means having a portion defining a path transverse to the vertical;

(c) bell moving means between said bell assembly and said frame means for moving said bell between a lower position adjacent the subsea surface and an upper position adjacent said frame means; and (d) means mounting said bell assembly for movement along the path defined by said portion of said frame means.

2. Diving apparatus as defined in claim 1 wherein the path defined by said frame means portion is substantially horizontal.

3. Diving apparatus as defined in claim 1 comprising means for moving said bell assembly along the path.

4. Diving apparatus as defined in claim 1 wherein said bell assembly includes a bell which is normally positively buoyant and a ballast weight movably secured thereto and which is sufficiently negatively buoyant to provide that the bell assembly is negatively buoyant.

5. Diving apparatus as defined in claim 4 wherein a bell winch is provided to which is attached one end of a cable connected at the other end to the ballast weight so that upon operation of said winch the positively buoyant bell moves upwardly away from said ballast weight.

6. Diving apparatus as defined in claim 4 comprising means for raising and lowering the ballast weight with respect to said frame means.

7. Diving apparatus as defined in claim 1 further comprising guide wire means extending from a well location at the subsea surface to the sea surface, said frame means being movable vertically along said guide wire means.

8. Diving apparatus comprising:

(a) a guide wire system extending from a location at the seabed where work is to be performed and the sea surface and including wires disposed laterally of the work location;

(b) a normally negatively buoyant bell assembly including a positively buoyant bell and a negatively buoyant ballast weight removably connected thereto;

(c) sliding frame means movable vertically along said guide wire system beneath the sea surface between an upper position at the sea surface and a lower position sufficiently above the subsea surface to permit vertical movement of the bell assembly to the vicinity of the work location, the frame means being temporarily stationary at said lower position by abutment with a portion of said guide wire system and said frame means having a portion defining a path which is transverse to the vertical and which at least partially surrounds the work location;

(d) bell moving means connected between said bell assembly and said frame means for moving said bell between a lower position adjacent the subsea surface work location and an upper position adjacent said frame means when the latter is in its lower position; and (e) means mounting said bell assembly for movement along said path.

9. Diving apparatus as defined in claim 8 wherein said path defined by said frame means portion is substantially horizontal.

10. Diving apparatus comprising:

(a) a bell assembly normally negatively buoyant and including a bell;

(b) frame means movable vertically beneath the sea surface between an upper position and a lower position above the subsea surface and at which said frame means may be temporarily made stationary, said frame means having a portion defining a path in the form of a closed loop;

(c) bell moving means between said bell assembly and said frame means for moving said bell between a lower position adjacent the subsea surface and an upper position adjacent said frame means; and (d) means mounting said bell assembly for movement along the path defined by said portion of said frame means.

11. Diving apparatus as defined in claim 10 wherein said path is circular.

12. Diving apparatus as defined in claim 11 wherein said guide wire means includes four wires arranged so that when viewed from above imaginary lines connecting the adjacent wires form a square.

13. Diving apparatus as defined in claim 12 wherein said mounting means are located sufficiently outwardly of the square formed by the imaginary lines connecting said guide wires that the bell assembly cannot contact said guide wires.

14. Diving apparatus as defined in claim 13 further comprising manipulator means connected to said bell for operating upon equipment at the work location.

15. Diving apparatus comprising:

(a) a bell assembly normally negatively buoyant and including a bell;

(b) frame means movable vertically beneath the sea surface between an upper position and a lower position above the subsea surface and at which said frame means may be temporarily made stationary, said frame means having a path defining portion;

(c) bell moving means between said bell assembly and said frame means for moving said bell between a lower position adjacent the subsea surface and an upper position adjacent said frame means; and (d) means mounting said bell assembly for movement along the path defined by said portion of said frame means and including a carriage arranged to support the bell assembly and move along said path.

16. Diving apparatus as defined in claim 15 wherein said path includes a track on which said carriage moves.

17. Diving apparatus as defined by claim 16 wherein said path is circular and includes a pair of closed loop annular track members in radially spaced relationship to one another.

18. Diving apparatus as defined by claim 17 wherein each of said track members, respectively, is a closed loop comprising a vertical member having one end connected to said path defining portion of said frame and having the opposite end extending downward therefrom and a horizontal member having one end connected to the downward extending end of said vertical member and having a free end, the free ends of the horizontal members of each of said track members are in facing arrangement with respect to each other.

19. Diving apparatus as defined by claim 17 wherein said carriage includes a frame; wheels connected to said frame and coacting with said track members; and drive means for moving said carriage along said path.

20. Diving apparatus as defined by claim 19 wherein said carriage further includes a ballast weight winch whereby upon operation of said winch the ballast weight moves between a position adjacent to the bottom of said bell and a position adjacent the subsea surface; an umbilical winch whereby upon operation of said umbilical winch an umbilical line is extended in proportion to the distance between the bell and the frame means; and a guide means for guiding an umbilical line outwardly beyond said frame means.

21. Diving apparatus as defined by claim 19 wherein said drive means includes a drive track connected to the path defining portion of said frame means and a traveling gear mechanism connected to said carriage having gears which interact with said drive track.

22. Diving apparatus comprising:

(a) a bell assembly normally negatively buoyant and including a bell which is normally positively buoyant and a ballast weight movably secured thereto and which is sufficiently negatively buoyant to provide that the bell assembly is negatively buoyant;

(b) frame means movable vertically beneath the sea surface between an upper position and a lower position above the subsea surface and at which said frame means may be temporarily made stationary, said frame means having a path defining portion, said ballast weight being connected to said frame means by a ballast weight winch whereby upon operation of said winch the ballast weight moves between a position adjacent the bottom of the bell and a position adjacent the subsea surface;

(c) bell moving means between said bell assembly and said frame means for moving said bell between a lower position adjacent the subsea surface and an upper position adjacent said frame means; and (d) means mounting said bell assembly for movement along the path defined by said portion of said frame means.

23. Diving apparatus comprising:

(a) a guide wire system extending from a location at the seabed where work is to be performed and the sea surface and including wires disposed laterally of the work location;

(b) a normally negatively buoyant bell assembly including a positively buoyant bell and a negatively buoyant ballast weight removably connected thereto;

(c) sliding frame means movable vertically along said guide wire system beneath the sea surface between an upper position at the sea surface and a lower position sufficiently above the subsea surface to permit vertical movement of the bell assembly to the vicinity of the work location, the frame means being temporarily stationary at said lower position by abutment with a portion of said guide wire system and said frame means having a portion defining a circular path which at least partially surrounds the work location;

(d) bell moving means connected between said bell assembly and said frame means for moving said bell between a lower position adjacent the subsea surface work location and an upper position adjacent said frame means when the latter is in its lower position; and (e) means constituted by a carriage which moves along said path, said carriage mounting said bell assembly for movement along said path.

24. Diving apparatus as defined in claim 23 wherein said path includes a pair of closed loop annular track members in radially spaced relationship to one another and said carriage includes a frame; wheels connected to said frame and coacting with said track members; and drive means for moving said carriage along said path.

25. Diving apparatus as defined in claim 24 wherein said drive means includes a drive track connected to the path defining portion of said path defining portion of said frame means and a traveling gear mechanism connected to said carriage having gears which interact with said drive track.

* * * * *